US006016758A

United States Patent [19]

Tomita

[11] Patent Number: 6,016,758

[45] Date of Patent: Jan. 25, 2000

[54] SEWING MACHINE

[75] Inventor: Shintaro Tomita, Nagoya, Japan

[73] Assignee: Brother Kogyo Kabushiki Kaisha, Nagoya, Japan

[21] Appl. No.: 09/159,102

[22] Filed: Sep. 23, 1998

[30] Foreign Application Priority Data

Sep. 29, 1997 [JP] Japan ..... 9-264699

[51] Int. Cl.[7] ..... D05B 21/00

[52] U.S. Cl. ..... 112/470.04; 112/102.5; 112/445; 702/115

[58] Field of Search ..... 112/470.04, 470.01, 112/470.02, 470.06, 102.5, 445, 456, 458, 275, 277; 702/115, 185, 182, 183, 184

[56] References Cited

U.S. PATENT DOCUMENTS

| | | | |
|---|---|---|---|
| 4,359,953 | 11/1982 | Martell et al. | 112/470.02 |
| 5,050,513 | 9/1991 | Frankel | 112/470.02 |
| 5,427,044 | 6/1995 | Hirabayashi | 112/445 |
| 5,583,801 | 12/1996 | Croyle et al. | 702/115 |
| 5,881,657 | 3/1999 | Asano | 112/470.02 X |

FOREIGN PATENT DOCUMENTS

| | | |
|---|---|---|
| 4-242830 | 8/1992 | Japan . |
| 6-327862 | 11/1994 | Japan . |
| 7-39662 | 2/1995 | Japan . |

*Primary Examiner*—Peter Nerbun
*Attorney, Agent, or Firm*—Oliff & Berridge, PLC

[57] ABSTRACT

A sewing machine is provided with: a stitch forming device; a driving device for driving the stitch forming device; a controller for controlling the driving device; an inputting device for inputting peculiar information, which is related to management of the sewing machine and peculiar to the sewing machine; a memory for storing the peculiar information inputted by the inputting device; and a displaying device for displaying the peculiar information stored in the memory.

19 Claims, 6 Drawing Sheets

SEWING MACHINE

BACKGROUND OF THE INVENTION

1. Field of the Invention

The present invention relates to a sewing machine, which includes a CPU (Central Processing Unit) to electrically enable an information process such as a selection of a pattern to be sewn etc., and in which an automatic sewing process can be performed.

2. Description of the Related Art

There is a so-called embroidery sewing machine provided with a microcomputer including a CPU, in which various processes can be performed such as a process of automatically sewing a desirable embroidery just by selecting a desirable pattern to be embroidered on a touch panel or the like.

However, according to the above mentioned embroidery sewing machine, it is not performed to systematically memorize or store the history of the pertinent sewing machine etc., in case that the pertinent sewing machine has been repaired. Thus, it is not possible to obtain later such information that what kind of repair has been applied, which part or component has been replaced and so on. Hence, it is difficult to rationally manage the pertinent sewing machine.

SUMMARY OF THE INVENTION

Given these circumstances, it is an object of the present invention to provide a sewing machine, which can be managed systematically and conveniently as for a repair or the like.

The above object of the present invention can be achieved by a sewing machine provided with: a stitch forming device; a driving device for driving the stitch forming device; a controller for controlling the driving device; an inputting device for inputting peculiar information, which is related to management of the sewing machine and peculiar to the sewing machine; a memory for storing the peculiar information inputted by the inputting device; and a displaying device for displaying the peculiar information stored in the memory.

According to the present invention, the peculiar information, which is related to management of the sewing machine and peculiar to the sewing machine, is inputted by the inputting device. Then, the peculiar information inputted by the inputting device is stored into the memory. Then, the peculiar information stored in the memory is displayed by the displaying device. Accordingly, it is possible to improve the convenience in the systematic management as for a repair, a maintenance or the like, of the individual sewing machine since the peculiar information peculiar to the individual sewing machine can be inputted, stored, updated and displayed.

In one aspect of the preset invention, the memory is provided with a non-volatile type memory.

According to this aspect, the peculiar information inputted by the inputting device can be stored into and maintained by the non-volatile type memory such as an EEPROM or the like even if the electric source for the sewing machine is turned off.

In another aspect of the present invention, the peculiar information is provided with history information, which indicates a history of the sewing machine.

According to this aspect, since the history information can be inputted, stored, updated and displayed, it is possible to systematically manage the sewing machine after recognizing the history of the sewing machine when a repair, an overhaul, a maintenance etc., are to be applied to the sewing machine.

In this aspect in which the history information is included in the peculiar information, the history information may be provided with repair history information, which indicates a history of a repair of the sewing machine.

Accordingly, in this case, since the repair history information can be inputted, stored, updated and displayed, it is possible to systematically repair the sewing machine after recognizing the repair history of the sewing machine when the sewing machine is failed or damaged.

In this case, the repair history information may be provided with information indicating contents of a plurality of operations performed for the sewing machine until an occurrence of a failure of the sewing machine.

Accordingly, in this case, since the information indicating the contents of the operations performed until the occurrence of the failure is included in the history information, it is possible to speedily search and find out the cause of the failure or trouble by displaying the history information.

In the aspect in which the history information is included in the peculiar information, the history information may be provided with information related to a purchase of the sewing machine.

Accordingly, in this case, since the information related to the purchase of the sewing machine is included in the history information, it is possible to easily manage the sewing machine after the purchase.

In the aspect in which the history information is included in the peculiar information, the history information may be provided with information indicating a serial number of the sewing machine.

Accordingly, in this case, since the information indicating the serial number of the sewing machine is included in the history information, it is possible to improve the convenience in making an inquiry as for the sewing machine M to the producer or manufacturer.

In the aspect in which the history information is included in the peculiar information, the history information may be provided with information indicating a sewing time which indicates a total time duration of a sewing process performed by the sewing machine until a time of displaying the peculiar information.

Accordingly, in this case, since the information indicating the sewing time is included in the history information, it is possible to perform the systematic management as for a repair, a maintenance or the like, of the individual sewing machine.

In another aspect of the present invention, the peculiar information is provided with repair history information, which indicates a history of a repair of the sewing machine, and the memory is provided with a non-volatile type memory for storing only the repair history information among the peculiar information.

According to this aspect, the repair history information inputted by the inputting device can be stored into and maintained by the non-volatile type memory such as an EEPROM or the like even if the electric source for the sewing machine is turned off. Thus, it is possible to systematically repair the sewing machine after recognizing the repair history of the sewing machine when the sewing machine is failed or damaged after the electric source for the sewing machine is once turned off and on.

In another aspect of the present invention, the displaying device is provided with a display panel, and the inputting device is provided with a touch panel integrated with the display panel so that the touch panel can be operated on a picture plane of the display panel.

According to this aspect, the peculiar information can be easily inputted by the touch panel on the picture plane of the display panel.

In another aspect of the present invention, the inputting device is provided with an interface device through which the peculiar information is inputted from an external device.

According to this aspect, the peculiar information can be easily inputted through the interface device from the external device such as a personal computer or the like by the use of a communication line.

In another aspect of the present invention, the inputting device is provided with an interface device through which an operation command to display the peculiar information is inputted from an external device.

According to this aspect, when the operation command to display the peculiar information is inputted through the interface device from an external device such as a personal computer or the like by the use of a communication line, the peculiar information is displayed on the displaying device. Accordingly, the peculiar information can be displayed as the occasion demands, in accordance with the operation command from the external device operated by the repairer or the like.

In another aspect of the present invention, the sewing machine is further provided with an interface device through which the peculiar information stored in the memory is outputted to an external device.

According to this aspect, since the peculiar information stored in the memory is outputted through the interface device to the external device such as a personal computer or the like by the use of a communication line, the peculiar information can be recognized by the repairer or the like via the external device.

In another aspect of the present invention, the displaying device is provided with a display panel on which an operation command to select a pattern of sewing is inputted.

According to this aspect, the operation command to select the pattern of sewing can be inputted on the display panel when the sewing process is to be performed while the peculiar information can be displayed on the same display panel when the repair or the like is to be performed.

In another aspect of the present invention, the sewing machine is further provided with a key or button for inputting an operation command to perform a predetermined operation when the key or button is operated in one manner and for inputting an operation command to display the peculiar information stored in the memory when the key or button is operated in another manner.

According to this aspect, when the key or button is operated in one manner, the operation command to perform a predetermined operation is inputted. On the other hand, when the key or button is operated in another manner, the operation command to display the peculiar information stored in the memory is inputted.

In this aspect, the operation command to perform the predetermined operation may be inputted when the key or button is operated for a first time duration and the operation command to display the peculiar information may be inputted when the key or button is operated for a second time duration longer than the first time duration.

In this case, when the key or button is operated for the first time duration (e.g., a few seconds), the operation command to perform the predetermined operation is inputted. On the other hand, when the key or button is operated for a second time duration longer than the first time duration (e.g., a several tens seconds), the operation command to display the peculiar information is inputted.

Also in this aspect, the displaying device may be provided with a display panel, and the key or button may be provided with a key or button on a touch panel integrated with the display panel so that the key or button can be operated on a picture plane of the display panel.

In this case, the operation command can be inputted on the touch panel on the picture plane of the display panel.

In another aspect of the present invention, the sewing machine is further provided with a key or button for inputting an operation command to display the peculiar information stored in the memory, which is disposed at a position inaccessible in a normally operating status of the sewing machine.

According to this aspect, since the key or button for inputting the operation command to display the peculiar information is disposed at the inaccessible position, it is possible to prevent the user from changing the peculiar information inadvertently, which is not really necessary for the user to see. For example, such a key or button may be disposed behind a cover of the sewing machine.

The nature, utility, and further features of this invention will be more clearly apparent from the following detailed description with respect to preferred embodiments of the invention when read in conjunction with the accompanying drawings briefly described below.

BRIEF DESCRIPTION OF THE DRAWINGS

FIG. 5A is a plan view of a picture plane for displaying the repair history information and the like.

FIG. 5B is a plan view of a picture plane for inputting the repair history information and the like.

DETAILED DESCRIPTION OF THE PREFERRED EMBODIMENT

A preferred embodiment for the present invention will be explained with reference to the drawings.

At first, an appearance of a sewing machine of the embodiment, which is an embroidery sewing machine, is explained with reference to FIG. 1.

Figure 1:
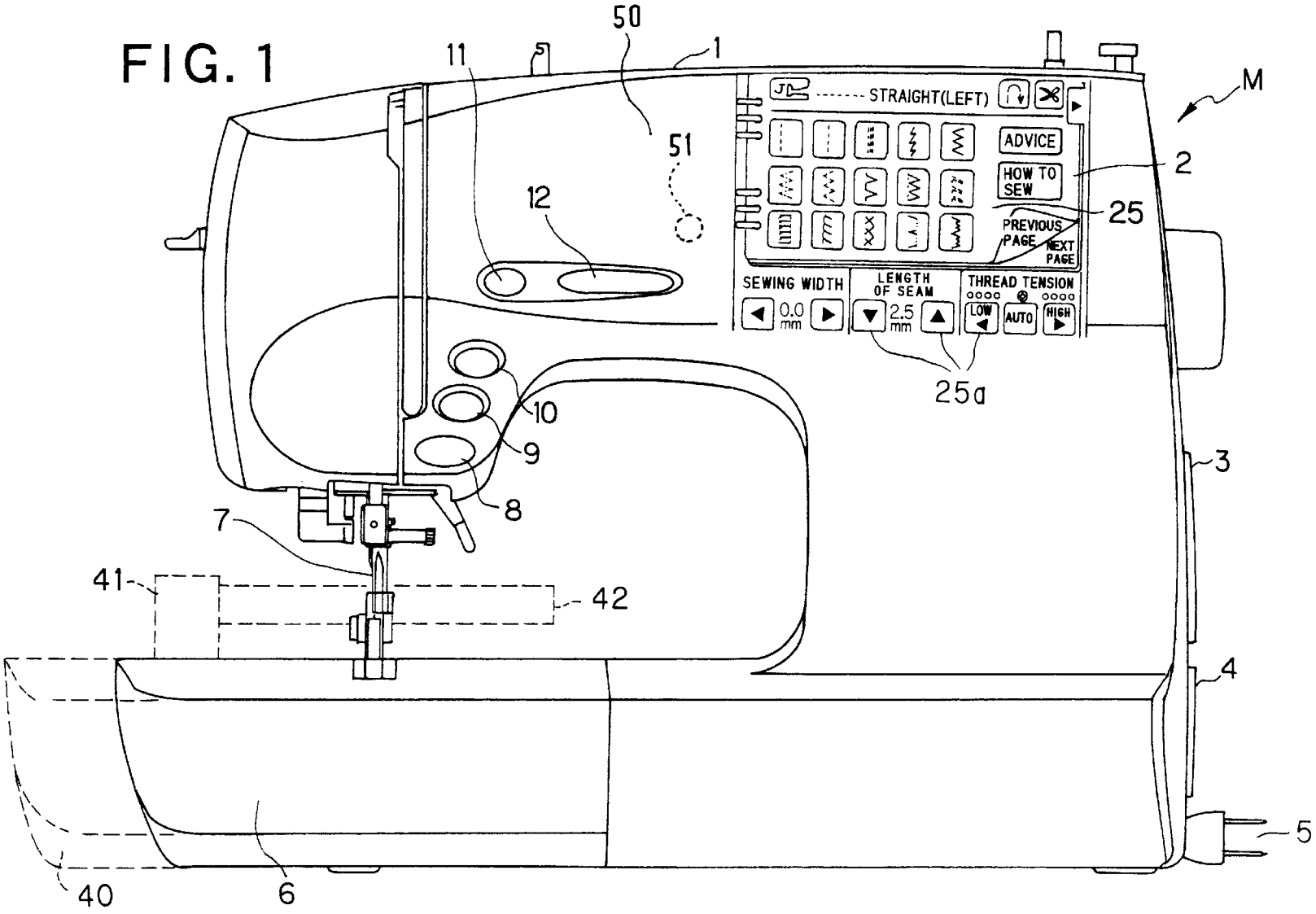
FIG. 1 is a side view showing a schematic appearance of a sewing machine according to an embodiment of the present invention.

In FIG. 1, a sewing machine M is provided, on a main body 1, with: an LCD (Liquid Crystal Display) panel 2 as one example of a displaying device for displaying an operation status etc., of the sewing machine M during sewing various embroideries; a card connector 3 to which an external ROM (Read Only Memory) etc., for storing various embroidery patterns set in advance is to be connected; a communication connector 4 for performing transmission and reception of data by connecting an external computer with the sewing machine M; an electric source cable 5; a cloth fixing platform 6 on which a cloth is fixed during sewing; a sewing needle 7 for actually sewing; a start/stop button 8 operated when the sewing operation is to be started and stopped; a backstitch button 9 operated when a backstitch is performed; a needle up and down button 10 operated when the sewing needle 7 is manually moved up and down; a thread cutting button 11 operated when a thread is cut after sewing etc.; and a motor speed control 12 for adjusting a rotation speed of a motor to move up and down the sewing needle 7.

Incidentally, on a surface of the LCD panel 2, a touch panel 25 is disposed as one example of an inputting device including one or more than one of a plurality of keys 25*a* to perform various inputting operations.

Further, in the cloth fixing platform 6, a rotating motor for moving the cloth fixed on the cloth fixing platform 6 within a X-Y plane perpendicular to the moving direction of the sewing needle 7 in correspondence with the pattern to be embroidered etc., a loop taker for storing a bobbin thread and so on are accommodated.

When actually sewing a sewing pattern, in addition to the constitutional elements of the sewing machine M as indicated by a solid line in FIG. 1, the sewing machine M is provided, as indicated by a dashed line in FIG. 1, with: an embroidery frame 42 for fixing a cloth to which a sewing pattern is to be embroidered; a moving body 41 for moving the embroidery frame 42 in a direction perpendicular to the paper surface of FIG. 1 in correspondence with the sewing pattern to be sewn; and an embroidering device 40 for moving the embroidery frame 42 in a direction parallel to the paper surface of FIG. 1 by moving the moving body 41 in a direction parallel to the paper surface of FIG. 1 in correspondence with the sewing pattern to be sewn. Within the embroidery device 40, an X direction driving motor 23 and a Y direction driving motor 24, which will be described later, are provided for moving the moving body 41 in a direction perpendicular to the paper surface of FIG. 1 and for moving the embroidery frame 42 within a plane perpendicular to the moving direction of the sewing needle 7.

Next, the internal structure of the sewing machine M is explained with reference to a block diagram shown in FIG. 2.

The operation of the sewing machine M is concentrically controlled by a signal processing unit 15 within the sewing machine M.

Figure 2:
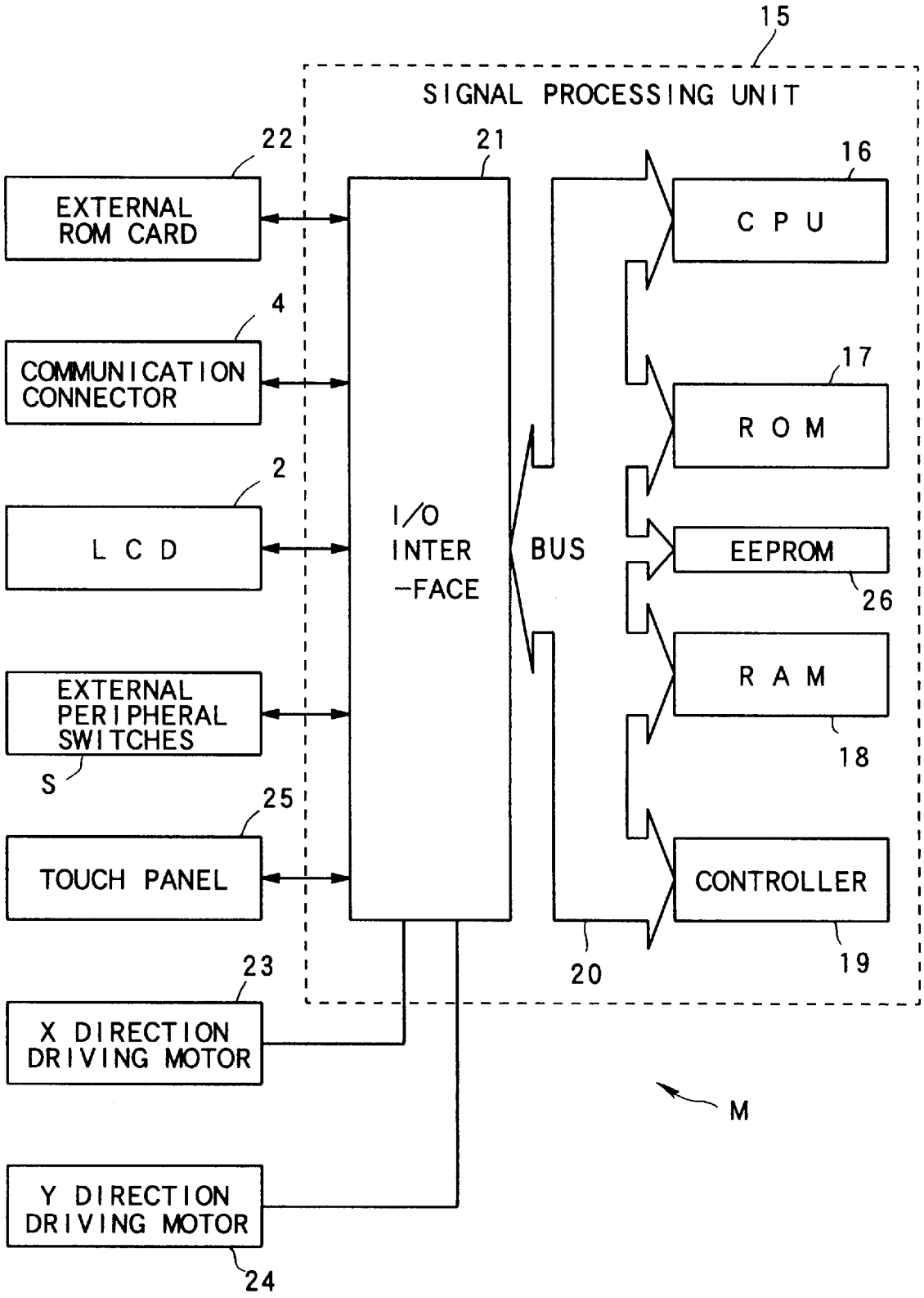
FIG. 2 is a block diagram showing an internal schematic construction of the sewing machine of the embodiment.

In FIG. 2, the signal processing unit 15 is provided with: a CPU 16 for actually performing a control of the sewing machine M; a ROM 17 for storing a control program for operating the CPU 16 etc., in advance in a readable manner; a RAM (Random Access Memory) 18 for temporarily storing data necessary for controlling the sewing machine M etc., in a readable manner; a communication bus 20 for connecting each constitutional element within the signal processing unit 15; a controller 19 for controlling the connections between the constitutional elements respectively by the communication bus 20 and an input/output (I/O) interface 21; and the input/output interface 21 for connecting the signal processing unit 15 with external constitutional elements.

Then, the signal processing unit 15 is connected through the input/output interface 21 with: an external ROM card 22 which is inserted into the card connector 3 (refer to FIG. 1); the communication connector 4; the LCD panel 2; external peripheral switches S (i.e., which is a generic name of the start/stop button 8, the backstitch button 9, the needle up and down button 10 etc., shown in FIG. 1 which are the buttons for operating the sewing machine M from the external); the touch panel 25; the X direction driving motor 23; the Y direction driving motor 24; and so on.

Incidentally, the operation of the sewing machine M of the present embodiment is performed under the control of the CPU 16. The program corresponding to the processing operation indicated by each flow chart, which will be described later, necessary for the control of the CPU 16 is stored in the ROM 17 in advance.

In the signal processing unit 15, there is equipped an EEPROM (Electrically Erasable/Programmable ROM) 26 as one example of a memory for storing peculiar information such as the repair history information or the like. The EEPROM 26 is adapted to electrically re-write the storage content and to maintain the storage content even after the electric source for the sewing machine M itself is turned off.

Next, the operation of the sewing machine M is explained with reference to FIG. 3 to FIG. 6. The embodiment explained below is such an embodiment that the present invention is applied to a case where the repair history information, which are records of the repair of the sewing machine M, is stored in the EEPROM 26 as the peculiar information peculiar to the sewing machine M.

Figure 3:
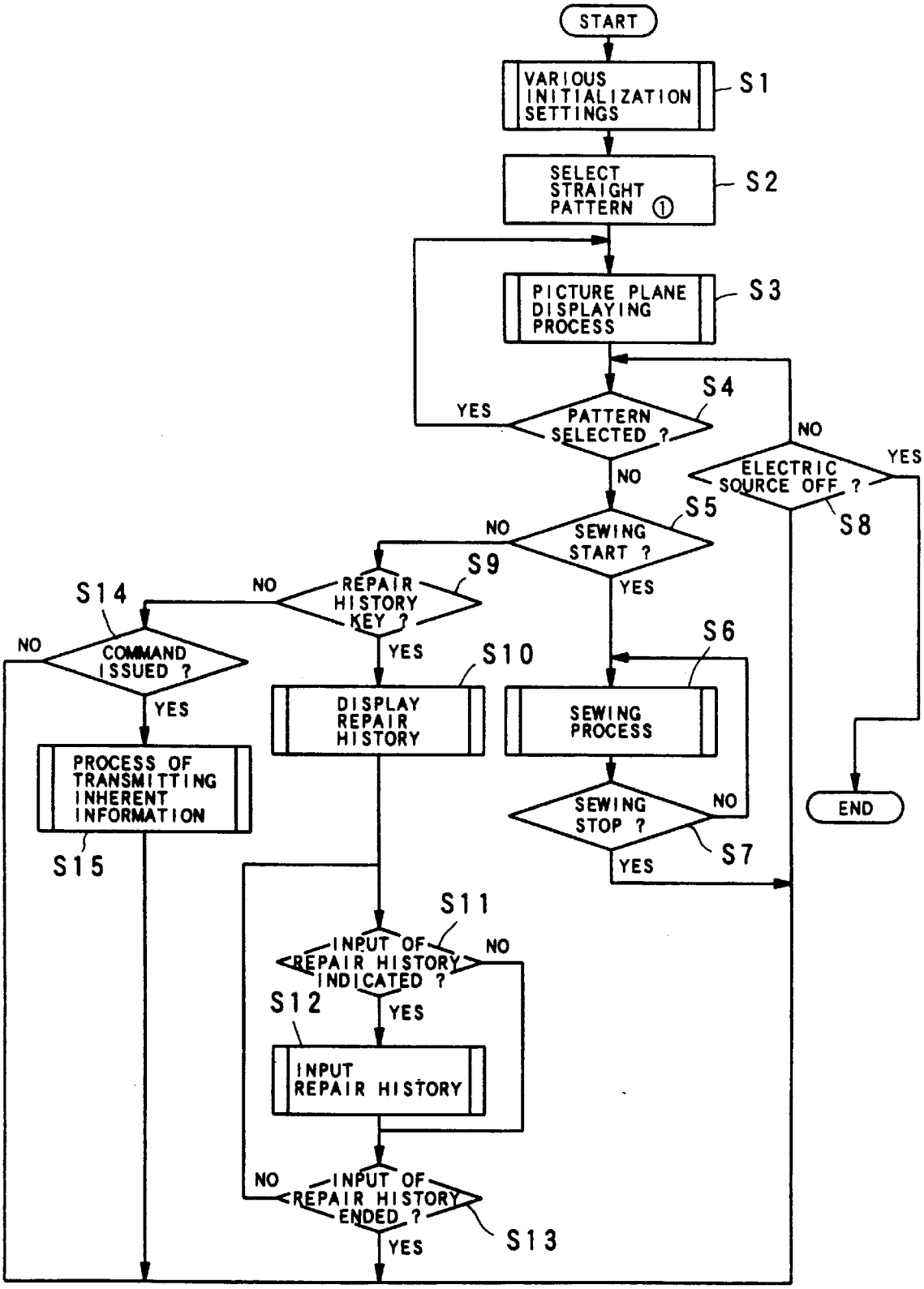
FIG. 3 is a flow chart indicating a whole operation of the sewing machine of the embodiment.

In FIG. 3, at first, when the electric source for the sewing machine M is turned on, various initialization settings (e.g., initialization of the RAM 18) are performed (Step S1). Then, as the initial setting value for the sewing process, a straight Pattern ① is selected (Step S2).

Next, a picture plane displaying process for displaying a picture plane (such as a picture plane shown in FIG. 1) to select the pattern to be sewn etc., on the LCD panel 2 is performed (Step S3).

Then, it is judged whether or not the selection process is performed by the use of the displayed picture plane and the touch panel 25 disposed on the surface thereof (Step S4). If the selection process is performed (Step S4: YES), the operational flow returns to the Step S3 so as to display the picture plane corresponding to the performed selection process. On the other hand, if the selection process is not performed or the selection process is ended (Step S4: NO), it is judged whether or not the operation indicating the sewing start is performed on the start/stop button 8 etc., (Step S5).

Then, if the sewing start is indicated (Step S5: YES), the sewing process is performed on the basis of the information selected on the LCD panel 2 (Step S6). After that, it is judged whether or not the stop of the sewing process is indicated by operating the start/stop button 8 again (Step S7). If the stop of the sewing process is not indicated (Step S7: NO), the operational flow returns to the Step S6 so as to continue the sewing process. If the stop of the sewing process is indicated (Step S7: YES), it is judged whether or not the electric source of the sewing machine M is turned off (Step S8).

Then, if the electric source is turned off (Step S8: YES), the process is directly ended. If the electric source is not turned off (Step S8: NO), the operational flow returns to the Step S4 so as to select a next pattern or the like.

On the other hand, according to the judgment result at the Step S5, if the start of the sewing process is not indicated (Step S5: NO), it is judged whether or not the repair history key to display the repair history information is operated (Step S9).

Here, the repair history key may not appear on the appearance of the sewing machine M. Since the repair history information in the present embodiment is provided to allow the repairer to check the repair conditions for example. Thus, the repair history information is not really necessary for the user to see. For this reason and also to prevent the user from changing the repair history inadvertently, a repair history key 51 to display the repair history information is disposed in the sewing machine M at a position inaccessible to the user, for example, behind a cover 50.

The repair history key may be constructed such that one of the aforementioned external peripheral switches S such as the backstitch button 9, the needle up and down button 10 etc., functions as the repair history key when it is operated in a special manner (e.g., when the same button is continuously pressed for several tens seconds) for example.

According to the judgment at the Step S9, if the repair history key is operated (Step S9: YES), the repair history information stored in the EEPROM 26 is displayed on the LCD 2 (Step S10). The process in the Step S10 will be explained later in detail.

When the repair history information is displayed, it is judged whether or not the new input of the repair history information is indicated on the picture plane of the repair history information (Step S11). If it is not indicated (Step S11: NO), the operation flow directly proceeds to a Step S13. On the other hand, if the new input of the repair history information is indicated (Step S11: YES), the new input of the repair history information and the re-writing of the EEPROM 26 are performed (Step S12). The process in the Step S12 will be explained later in detail.

Then, it is judged whether or not the input of the repair history information is ended (Step S13). If it is ended (Step S13: YES), the operation flow directly branches to the Step S8. On the other hand, if it is not ended (Step S13: NO), the operation flow returns to the Step S11 so as to continue the input of the repair history information.

On the other hand, according to the judgment result at the Step S9, if the repair history key is not operated (Step S9: NO), it is judged whether or not a command to transmit the peculiar information including the repair history information to the external computer through the communication connector 4 is issued from the external computer (Step S14). If the command is not issued (Step S14: NO), the operation flow directly branches to the Step S8. On the other hand, if the command is issued (Step S14: YES), the peculiar information corresponding to the pertinent command is transmitted to the external computer (Step S15), and the operation flow proceeds to the Step S8. The process in the Step S15 will be explained later in detail.

Next, the process in the Step S10 is explained with reference to FIG. 4A and FIG. 5A.

Figure 4A:
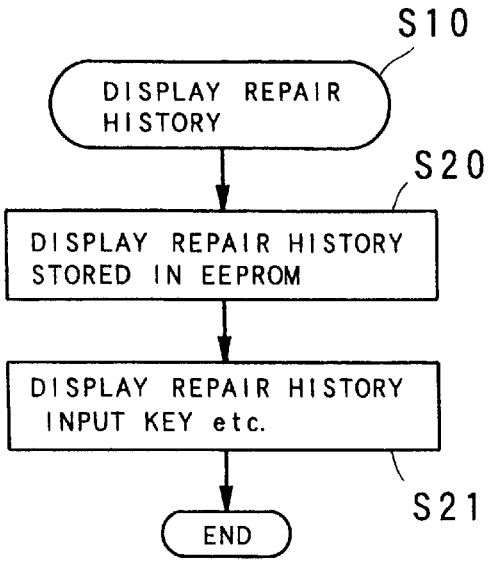
FIG. 4A is a flow chart indicating a detail operation of the sewing machine of the embodiment related to a process of displaying a repair history.

As shown in FIG. 4A, when the process in the Step S10 is started, the repair history information which is stored in the EEPROM 26 is displayed on the LCD panel 2 (Step S20). At this time, the picture plane is displayed as shown in FIG. 5A, for example.

Figure 5A:
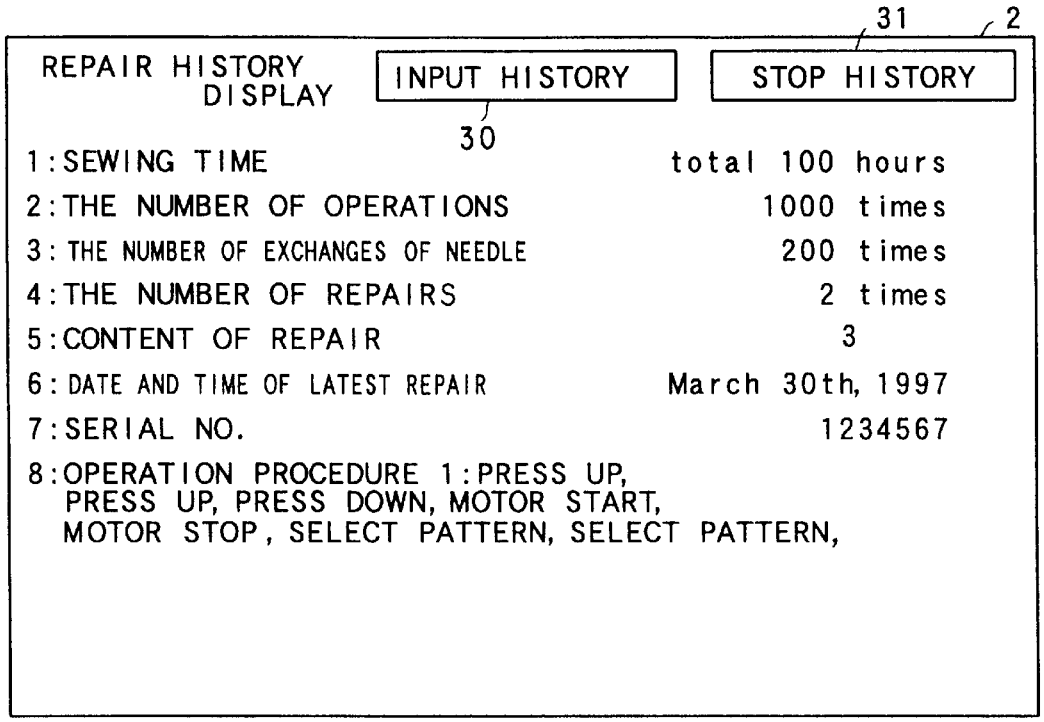

More specifically as shown in FIG. 5A, the total time duration of the sewing process until the present time point, the number of the operations accompanied with the sewing process (which is incremented by 1 each time the button is operated once), the number of the exchanges of the sewing needle 7, the number of the repairs of the sewing machine M, the information indicating the content of the latest repair, the date and time of the latest repair, the serial number (i.e., the production number) of the sewing machine M and the contents of a predetermined number of the latest operations are displayed. These pieces of displayed information have been stored in the EEPROM 26.

When the repair history information is displayed on the LCD panel 2, (i) a repair history input key 30 to instruct whether or not the repair history information is to be inputted and (ii) a repair history stop key 31 to instruct the stop of displaying the repair history information are displayed at one portion on the picture plane of the LCD panel 2 (Step S21). These keys are explained here with reference to FIG. 5A.

As shown in FIG. 5A, the above explained repair history input key 30 and the above explained repair history stop key 31 are displayed as keys on the touch panel 25. The repair history input key 30 is operated in correspondence with the above mentioned process at the Step S11, while the repair history stop key 31 is operated in correspondence with the above mentioned process at the Step S13, in FIG. 3.

When the display of the repair history input key 30 and the repair history stop key 31 in the Step S10 in FIG. 4A is ended, the operation flow proceeds to the Step S11 in FIG. 3, where the actual input operation is performed.

Next, the process at the step S12 in FIG. 3 is explained with reference to FIG. 4B and FIG. 5B.

Figure 4B:
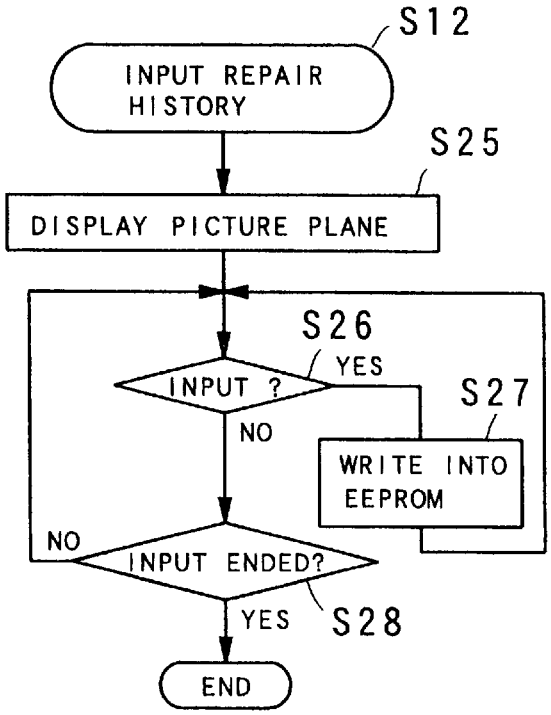
FIG. 4B is a flow chart indicating a detail operation of the sewing machine of the embodiment related to a process of inputting the repair history.
Figure 5B:
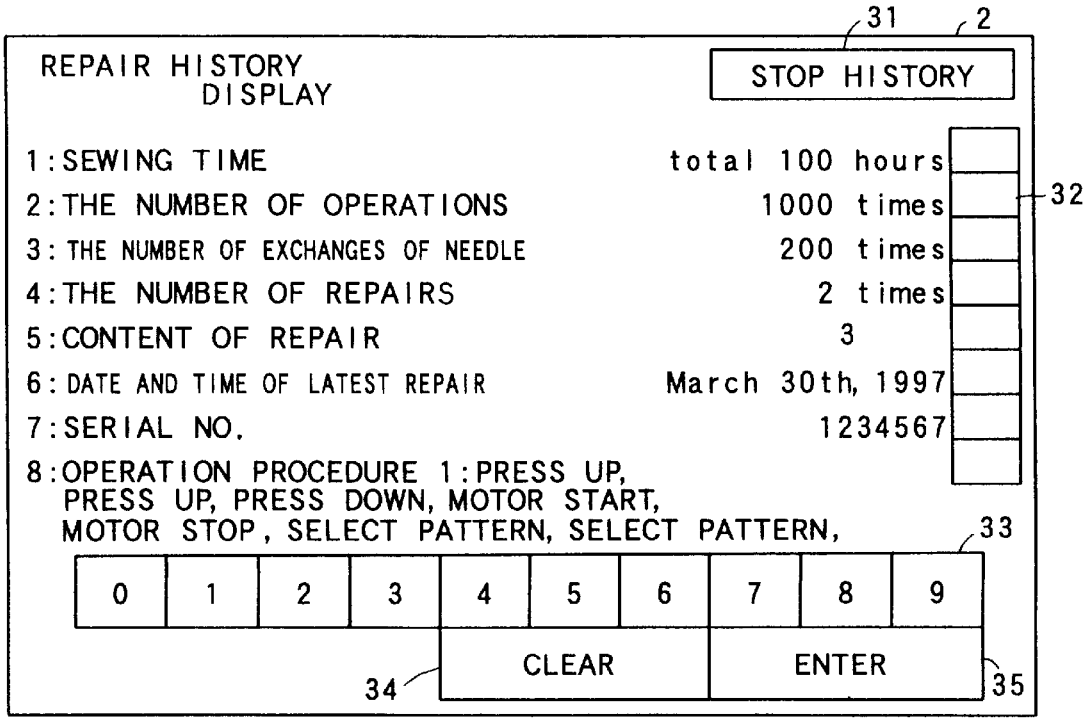

In FIG. 4B, when the operation flow proceeds to the Step S12, the picture plane as shown in FIG. 5B is displayed on the LCD panel 2. Namely, by operating the repair history input key 30 at the Step S11 in FIG. 3, the pertinent repair history input key 30 is erased from the picture plane on the LCD panel 2 at the Step S12. Instead, as shown in FIG. 5B, a ten key 33 to input the value indicating the actual repair history information, an enter key 35 to confirm the inputted value, a clear key 34 to clear the input by the ten key 33, and a display portion 32 to indicate the values of the respective inputted items are displayed on the LCD panel 2. These keys 33 to 35 are displayed as the keys or buttons on the touch panel 25. Then, as described later, when the number corresponding to each item on the display picture plane is inputted by the ten key 33 and it is confirmed upon completing the input by operating the enter key 35, the confirmed value is displayed on the display portion 32 of the corresponding item.

Namely, in FIG. 4B, at the Step S12, at first, the picture plane as shown in FIG. 5B is displayed (Step S25). Then, it is judged whether or not the repair history information is inputted by operating the ten key 33 etc., (Step S26). If it is not inputted (Step S26: NO), the operation flow branches to a Step S28. Then, it is judged whether or not the input of the repair history information is to be ended (Step S28). If it is to be ended (Step S28: YES), the operation flow directly proceeds to the Step S13, where the repair history stop key 31 is operated.

On the other hand, according to the judgment result at the Step S26, if the repair history information is newly inputted by operating the enter key 35 (Step S26: YES), the newly inputted repair history information is written into the EEPROM 26 for each item (Step S27). Then, the operation flow returns to the Step S26, so as to repeat the input of the repair history information.

Next, the operation at the Step S15 is explained with reference to FIG. 4D.

Figure 4C:
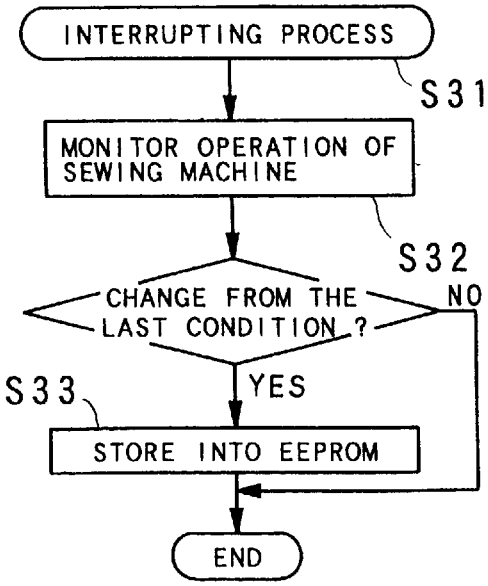
FIG. 4C is a flow chart indicating a detail operation of the sewing machine of the embodiment related to an interrupting process.
Figure 4D:
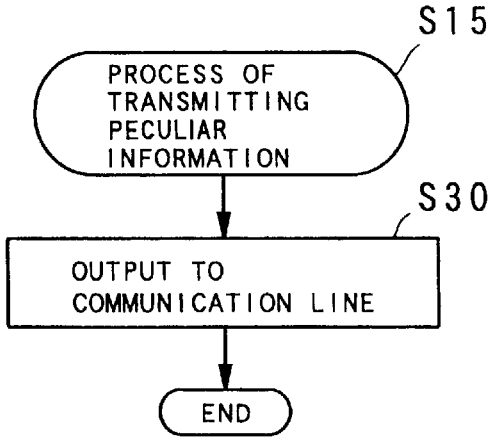
FIG. 4D is a flow chart indicating a detail operation of the sewing machine of the embodiment related to a process of transmitting peculiar information.

As shown in FIG. 4D, when the operation flow proceeds to the Step S15, the content of the EEPROM 26 is outputted and transmitted to the external computer through the communication connector 4 (Step S30).

Incidentally, in the above explained embodiment, the content of the operations performed with respect to the sewing machine M until an failure or trouble has occurred (i.e., until the repair history information is displayed) is displayed as a part of repair history information. Hence, in the sewing machine M, an interrupting process for recording the operation condition of the sewing machine M is performed as the occasion demands during the process shown in FIG. 3.

Namely, as shown in FIG. 4C, as the interrupting process, the operation with respect to the sewing machine M is always monitored (Step S31). Then, it is judged whether or not there is generated any change of the condition in the sewing machine from its latest condition (Step S32). If there is generated any change (Step S32: YES), the content of the operation at that time is written into the EEPROM 26 at a corresponding portion thereof (Step S33), and the operation flow returns to the main routine in FIG. 3.

This interrupting process is continually performed while the electric source of the sewing machine M is on.

Figure 6:
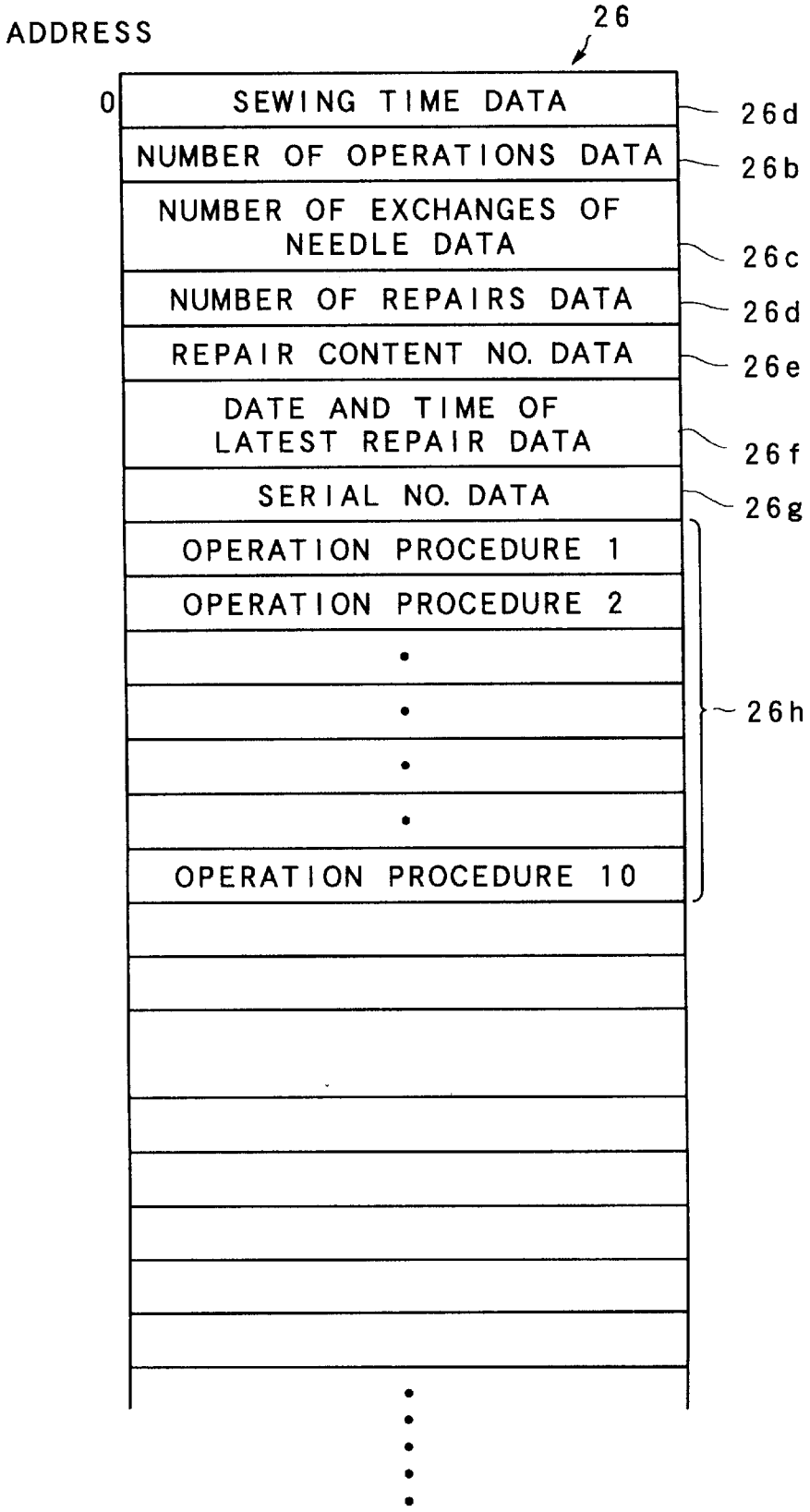
FIG. 6 is a diagram showing a data structure within an EEPROM (Electrically Erasable/Programmable Read Only Memory).

Next, the structure of the EEPROM 26, into which the information is written at the Step S27 or the Step S33 as above mentioned, is explained with reference to FIG. 6.

As shown in the data structure of FIG. 6, there are stored various data for respectively indicating each item as explained with reference to FIG. 5A and FIG. 5B, in the EEPROM 26. Namely, there are stored, in the EEPROM 26: sewing time data 26*a* which indicates the total time duration of the sewing process until the present time point; number of operations data 26*b* which indicates the number of the operations accompanied with the sewing process; number of exchanges of needle data 26*c* which indicates the number of the exchanges of the sewing needle 7; number of repairs data 26*d* which indicates the number of the repairs of the sewing machine M; repair content NO. data 26*e* which indicates the information indicating the content of the latest repair; date and time of latest repair data 26*f* which indicates the date and time of the latest repair; serial NO. data 26*g* which indicates the serial number of the sewing machine M; and operation procedure data 26*h* which indicates the contents of the latest 10 operations performed until the present time point. Among these, the sewing time data 26*a*, the number of operations data 26*b* and the operation procedure data 26*h* are updated by the interrupting process as shown in FIG. 4C. The operation procedure data 26*h* are stored in a reverse chronological order from the newest one, as "operation procedure 1", "operation procedure 2", . . . and "operation procedure 10".

On the other hand, the number of exchanges of needle data 26*c*, the number of repairs data 26*d*, the repair content NO. data 26*e* and the date and time of latest repair data 26*f* are inputted by the repairer who has performed the latest repair.

Further, as for the repair content NO. data 26*e*, each of the repair contents is correlated with respective one of predetermined numbers set in advance, so that the correlated number is inputted when the repair content NO. data 26*e* is updated.

According to the above described operation of the sewing machine M of the embodiment, since the repair history information of the sewing machine M can be stored, displayed and/or changed, it is possible to repair the sewing machine M when it is failed or in trouble after recognizing the repair condition in the past. Hence, the convenience for managing the sewing machine M can be improved.

Further, since the repair history information is stored in the EEPROM 26 which is a non-volatile type memory, the stored repair history information is not erased even when the electric source of the sewing machine is turned off.

Furthermore, since the repair history information includes the information as for a plurality of operation contents performed until the sewing machine M reaches to the failure or trouble, it is possible to speedily search and find out the cause of the failure or trouble.

Moreover, since the serial number of the pertinent sewing machine M is stored, the convenience in making an inquiry as for the sewing machine M to the producer or manufacturer can be improved.

In the above described embodiment, the case where the repair history information is stored as peculiar information has been explained. However, other than this case, it is possible to store the information at the time of purchasing the sewing machine M as the peculiar information. Here, if the shop or store name of the purchase, the date and time of the purchase, the name of the sales clerk in charge, the telephone number of the shop or store of the purchase and so on are stored as the information at the time of purchasing the sewing machine M, it is possible to easily manage the sewing machine M after the purchase without the necessity of making the guarantee or the like separately.

In the above described embodiment, although such a construction that the sewing machine M itself is equipped with the touch panel 25 as the inputting device for inputting the peculiar information has been explained, it is also possible to employ such a construction that the peculiar information is inputted by the repairer from the external personal computer or the like through the communication connector 4.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 09-264699 filed on Sep. 29, 1997 including the specification, claims, drawings and summary is incorporated herein by reference in its entirety.

What is claimed is:

1. A sewing machine comprising:

a stitch forming device;

a driving device that drives said stitch forming device;

a controller that controls said driving device;

an inputting device that inputs peculiar information, which is related to management of said sewing machine and peculiar to said sewing machine;

a memory that stores the peculiar information inputted by said inputting device;

a displaying device that displays the peculiar information stored in said memory; and a key or button that inputs an operation command to perform a predetermined operation when said key or button is operated in one manner and that inputs an operation command to display the peculiar information stored in said memory when said key or button is operated in another manner.

2. A sewing machine according to claim 1, wherein said memory comprises a non-volatile type memory.

3. A sewing machine according to claim 1, wherein the peculiar information comprises history information, which indicates a history of said sewing machine.

4. A sewing machine according to claim 3, wherein the history information comprises repair history information, which indicates a history of a repair of said sewing machine.

5. A sewing machine according to claim 4, wherein the repair history information comprises information indicating contents of a plurality of operations performed for said sewing machine until an occurrence of a failure of said sewing machine.

6. A sewing machine according to claim 3, wherein the history information comprises information related to a purchase of said sewing machine.

7. A sewing machine according to claim 3, wherein the history information comprises information indicating a serial number of said sewing machine.

8. A sewing machine according to claim 3, wherein the history information comprises information indicating a sewing time which indicates a total time duration of a sewing process performed by said sewing machine until a time of displaying the peculiar information.

9. A sewing machine according to claim 1, wherein the peculiar information comprises repair history information, which indicates a history of a repair of said sewing machine, and said memory comprises a non-volatile type memory for storing only the repair history information among the peculiar information.

10. A sewing machine according to claim 1, wherein said displaying device comprises a display panel, and said inputting device comprises a touch panel integrated with said display panel so that said touch panel can be operated on a picture plane of said display panel.

11. A sewing machine according to claim 1, wherein said inputting device comprises an interface device through which the peculiar information is inputted from an external device.

12. A sewing machine according to claim 1, wherein said inputting device comprises an interface device through which an operation command to display the peculiar information is inputted from an external device.

13. A sewing machine according to claim 1, further comprising an interface device through which the peculiar information stored in said memory is outputted to an external device.

14. A sewing machine according to claim 1, wherein said displaying device comprises a display panel on which an operation command to select a pattern of sewing is inputted.

15. A sewing machine according to claim 1 wherein the operation command to perform the predetermined operation is inputted when said key or button is operated for a first time duration and the operation command to display the peculiar information is inputted when said key or button is operated for a second time duration longer than the first time duration.

16. A sewing machine according to claim 1, wherein said displaying device comprises a display panel, and said key or button comprises a key or button on a touch panel integrated with said display panel so that said key or button can be operated on a picture plane of said display panel.

17. A sewing machine comprising:

a stitch forming means;

a driving means for driving said stitch forming means;

a controlling means for controlling said driving means;

an inputting means for inputting peculiar information, which is related to management of said sewing machine and peculiar to said sewing machine;

a memory means for storing the peculiar information inputted by said inputting means;

a displaying means for displaying the peculiar information stored in said memory means: and key or button means for inputting an operation command to perform a predetermined operation when said key or button means is operated in one manner and for inputting an operation command to display the peculiar information stored in said memory when said key or button means is operated in another manner.

18. A sewing machine according to claim 17, wherein the peculiar information comprises repair history information, which indicates a history of a repair of said sewing machine.

19. A sewing machine comprising:

a stitch forming device;

a driving device that drives said stitch forming device;

a controller that controls said driving device;

an inputting device that inputs peculiar information, which is related to management of said sewing machine and peculiar to said sewing machine;

a memory that stores the peculiar information inputted by said inputting device;

a displaying device that displays the peculiar information stored in said memory; and a key or button that inputs an operation command to display the peculiar information stored in said memory, which is disposed at a position inaccessible in a normally operating status of said sewing machine.

* * * * *